US010207277B2

(12) United States Patent
Newman et al.

(10) Patent No.: US 10,207,277 B2
(45) Date of Patent: Feb. 19, 2019

(54) ASSESSMENT AND CONTROL OF CENTRIFUGE OPERATION

(71) Applicant: HALLIBURTON ENERGY SERVICES, INC., Houston, TX (US)

(72) Inventors: Katerina V. Newman, Houston, TX (US); Dale E. Jamison, Humble, TX (US); Xiangnan Ye, Cypress, TX (US); Cato R. McDaniel, The Woodlands, TX (US); Timothy N. Harvey, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 400 days.

(21) Appl. No.: 14/434,498

(22) PCT Filed: Jun. 12, 2014

(86) PCT No.: PCT/US2014/042180
§ 371 (c)(1),
(2) Date: Apr. 9, 2015

(87) PCT Pub. No.: WO2015/191072
PCT Pub. Date: Dec. 17, 2015

(65) Prior Publication Data

US 2015/0360241 A1 Dec. 17, 2015

(51) Int. Cl.
*B04B 13/00* (2006.01)
*E21B 21/06* (2006.01)
*E21B 47/06* (2012.01)

(52) U.S. Cl.
CPC ..... *B04B 13/00* (2013.01); *E21B 21/06* (2013.01); *E21B 21/065* (2013.01); *E21B 47/06* (2013.01)

(58) Field of Classification Search
CPC ..... B04B 13/00; E21B 21/06; E21B 47/06
(Continued)

(56) References Cited

U.S. PATENT DOCUMENTS 5,857,955 A 1/1999 Phillips et al.
5,948,271 A * 9/1999 Wardwell ..... B04B 1/20 210/143
(Continued)

FOREIGN PATENT DOCUMENTS

CA 2624751 C * 12/2011 ..... E21B 21/062

OTHER PUBLICATIONS

International Search Report with Written Opinion dated Feb. 27, 2015 for PCT Patent Application No. PCT/US2014/042180, 12 pages.
(Continued)

*Primary Examiner* — Walter D. Griffin
*Assistant Examiner* — Shuyi S. Liu
(74) *Attorney, Agent, or Firm* — Chamberlain Hrdlicka

(57) ABSTRACT

A drilling fluid conditioning system can include a centrifuge, and at least one heat transfer property sensor that outputs real time measurements of a heat transfer property of a drilling fluid that flows through the centrifuge. A method can include measuring a heat transfer property of a drilling fluid, and determining, based on the measured heat transfer property, an operational parameter of a centrifuge through which the drilling fluid flows. A well system can include a drilling fluid that circulates through a wellbore, and a drilling fluid conditioning system including a centrifuge and at least one heat transfer property sensor that measures a heat transfer property of the drilling fluid.

15 Claims, 3 Drawing Sheets

(58) Field of Classification Search
USPC ..... 494/1, 10
See application file for complete search history.

(56) References Cited

U.S. PATENT DOCUMENTS

| | | | | |
|---|---|---|---|---|
| 7,540,838 | B2 | 6/2009 | Scott et al. | |
| 8,571,798 | B2 | 10/2013 | Atherton | |
| 2007/0087927 | A1* | 4/2007 | Scott | E21B 21/062 494/7 |
| 2008/0110253 | A1 | 5/2008 | Stephenson et al. | |
| 2011/0284288 | A1 | 11/2011 | Sawyer et al. | |
| 2012/0222854 | A1* | 9/2012 | McClung, III | E21B 21/065 166/75.12 |
| 2014/0290357 | A1* | 10/2014 | Zhang | G01F 23/246 73/295 |

OTHER PUBLICATIONS

Jafar Takabi, M.M. Khonsari; "Experimental testing and thermal analysis of ball bearings", Tribology International, dated Nov. 6, 2012, 93 pages.
Chris Maharaj, Andy Morris, John P. Dear; "Modelling of creep in Inconel 706 turbine disc fir-tree", Materials Science and Engineering A, dated Aug. 15, 2012, 412 pages.
Christopher Clauser, Ernst Huenges; "Thermal Conductivity of Rocks and Minerals", informational review, dated 1995, 22 pages.
Birch et al., "The Thermal Conductivity of Rocks and Its Dependence Upon Temperature and Composition," Am. Jour. Sc., Aug. 1940, vol. 238(8): pp. 529-558.

* cited by examiner

ASSESSMENT AND CONTROL OF CENTRIFUGE OPERATION

TECHNICAL FIELD

This disclosure relates generally to equipment utilized and operations performed in conjunction with subterranean wells and, in one example described below, more particularly provides for assessment and control of centrifuge operation in conditioning of drilling fluid.

BACKGROUND

Drilling fluid is an important element in a successful earth drilling operation. A centrifuge is commonly used in conditioning drilling fluid before it is returned to a drill string. Thus, it will be appreciated that improvements are continually needed in the arts of assessing and/or controlling operation of a centrifuge while drilling.

DETAILED DESCRIPTION

Figure 1:
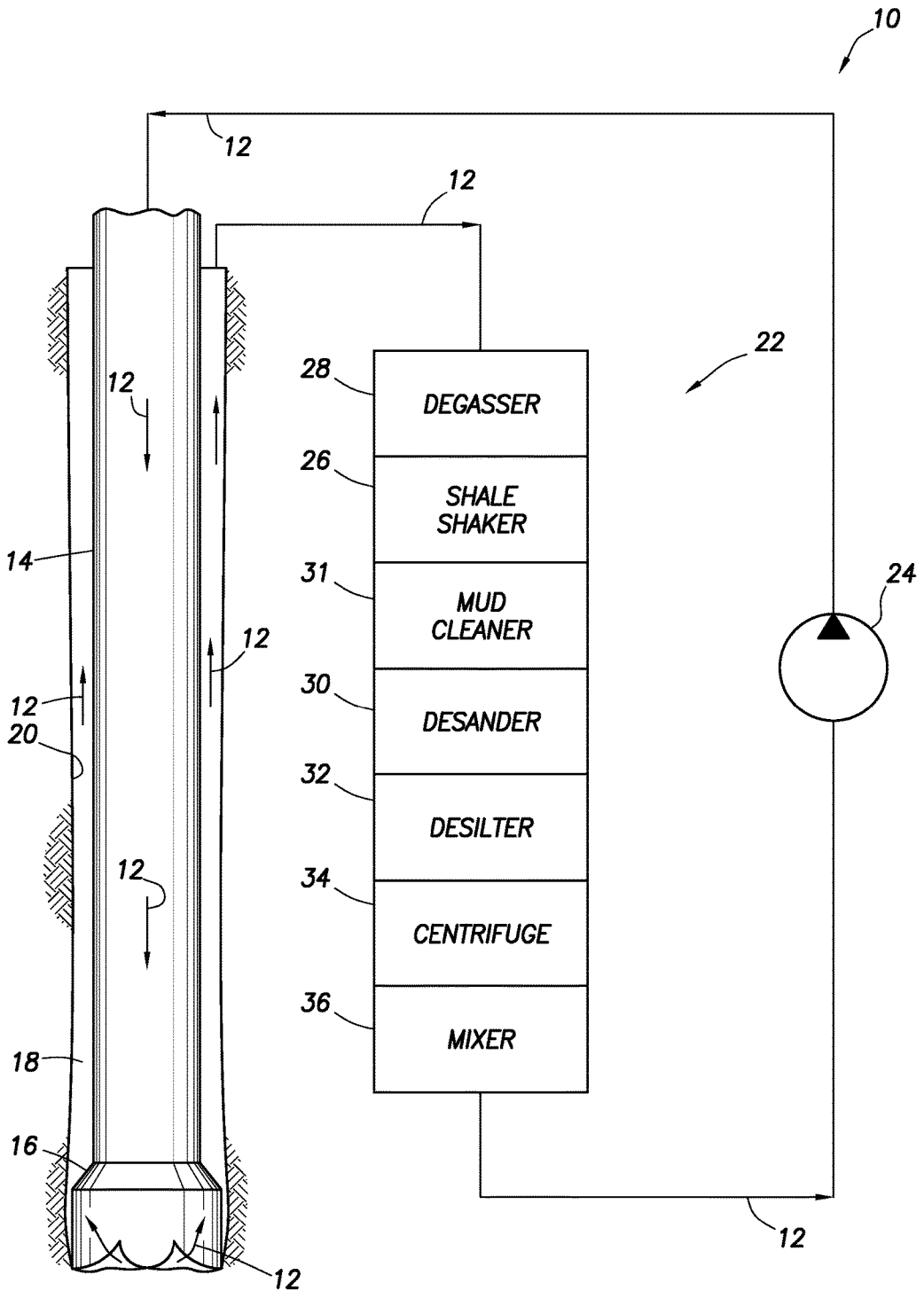
FIG. 1 is a representative partially cross-sectional view of a well system and associated method that can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a drilling fluid 12 (also known to those skilled in the art as drilling "mud") is circulated through a drill string 14, out of a drill bit 16 at a distal end of the drill string, and back to the earth's surface via an annulus 18 between the drill string and a wellbore 20. The drilling fluid 12 is conditioned at the surface by a drilling fluid conditioning system 22 prior to being pumped back into the drill string 14 by a rig mud pump 24.

As used herein, the term "earth's surface" is used to indicate a location at or near a surface of the earth. The earth's surface can be on land or on water. A drilling fluid conditioning system will be at the earth's surface, for example, if it is on a floating or fixed offshore rig, or at a land rig.

The drilling fluid conditioning system 22 depicted in FIG. 1 includes several drilling fluid conditioning devices, namely, a shale shaker 26, a degasser 28, a desander 30, a mud cleaner 31, a desilter 32, a centrifuge 34 and a mixer 36. More, fewer, other or different drilling fluid conditioning devices may be included in the system 22, if desired. Thus, the scope of this disclosure is not limited to any particular configuration, arrangement, number or combination of drilling fluid conditioning devices in the system 22.

The shale shaker 26, desander 30, mud cleaner 31, desilter 32 and centrifuge 34 remove progressively finer drill cuttings, sand, formation fines and other substances from the drilling fluid 12. The degasser 28 removes entrained gas from the drilling fluid 12. The mixer 36 is used to add weighting materials, fluid loss control agents, chemicals and other substances to the drilling fluid 12 as needed, prior to the drilling fluid being pumped into the drill string 14 by the pump 24.

In the FIG. 1 example, the drilling fluid conditioning system 22 further includes thermal conductivity sensors 38, 40, 42 (not visible in FIG. 1, see FIGS. 2 & 3) connected upstream and downstream of the centrifuge 34. In other examples, thermal conductivity sensors could be connected between, or integrated as part of, any of the drilling fluid conditioning devices 26, 28, 30, 31, 32, 34, 36. One or multiple thermal conductivity sensors may be used in the system 22. Thus, the scope of this disclosure is not limited to any particular number, location (or combination of locations) of thermal conductivity sensors in the system 22.

Any suitable thermal conductivity sensor may be used in the system 22. Typically, a thermal conductivity sensor will include a heating element and a temperature sensor for detecting a temperature of a heated substance. However, other types of thermal conductivity sensors may be used, if desired.

The thermal conductivity sensors 38, 40, 42 provide real time measurements of the thermal conductivity of the drilling fluid 12, thereby enabling important decisions about how to manage properties of the drilling fluid 12 to be made quickly. If, for example, a density or solids content of the drilling fluid 12 is not within a desired range, adjustments can be made in the drilling fluid conditioning system 22.

The term "thermal conductivity" is used herein to indicate a heat transfer property of a drilling fluid. Other heat transfer properties that could be measured by the sensors 38, 40, 42 include thermal inertia, thermal effusivity and thermal diffusivity. Thus, the scope of this disclosure is not limited to measurement of only thermal conductivity of a drilling fluid. Thermal conductivity is merely one example of a heat transfer property that could be measured, evaluated, controlled, etc., using the principles of this disclosure.

As used herein, the term "real time" is used to indicate immediate performance of an activity. An activity is considered to be performed in real time if the activity is instantaneous or takes no more than a few seconds to perform. An activity that takes many minutes, or an hour or more to perform, is not considered to be performed in real time.

Thermal conductivity and other heat transfer properties of the drilling fluid 12 are related to its constituents. For particular drilling fluid types, if the thermal conductivity of the drilling fluid is known, its constituents can be determined. For example, if drill cuttings being received from the wellbore 20 with the drilling fluid 12 are from a type of formation rock for which a thermal conductivity is known (see, e.g., C. Clauser and E. Huenges, "Thermal Conductivity of Rocks and Minerals" (1995) and A. F. Birch and H. Clark, "The Thermal Conductivity of Rocks and Its Dependence Upon Temperature and Composition" (1940)), a contribution of this constituent to the thermal conductivity of the drilling fluid returning from the wellbore can be determined.

Figure 2:
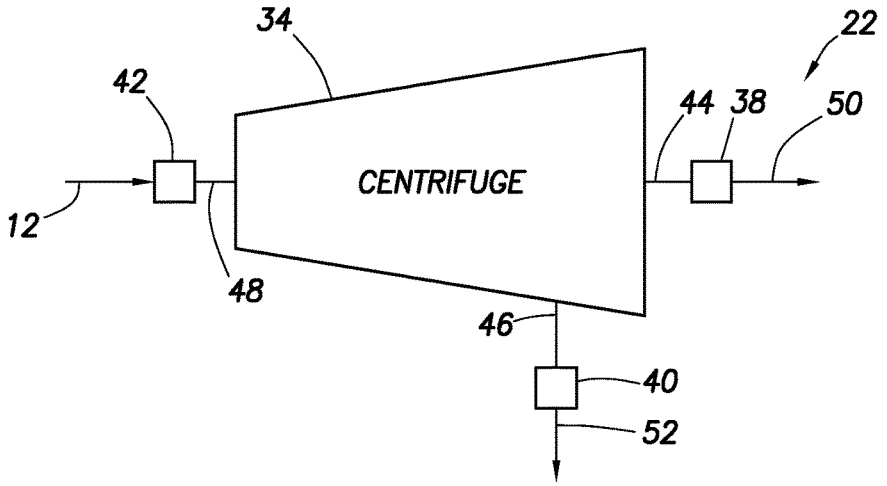
FIG. 2 is a representative schematic of a drilling fluid conditioning system that can embody principles of this disclosure.

FIG. 2 is a representative schematic of one example of the drilling fluid conditioning system 22 that can embody principles of this disclosure. Only the centrifuge 34 portion of the system 22 is depicted in FIG. 2. In this example, the thermal conductivity (or other heat transfer property) sensor 38 is connected at an output 44 of the centrifuge 34, thermal conductivity (or other heat transfer property) sensor 40 is connected at an output 46 of the centrifuge, and thermal conductivity (or other heat transfer property) sensor 42 is connected at an input 48 to the centrifuge.

The input 48 is where the centrifuge 34 receives a feed of the drilling fluid 12. For example, in the FIG. 1 system 22, the centrifuge 34 receives the drilling fluid 12 from the desilter 32. However, the scope of this disclosure is not limited to any particular source for the drilling fluid 12 received at the centrifuge 34 input 48.

The outputs 44, 46 are where different density substances 50, 52 are discharged from the centrifuge 34. For example, the substance 50 could be a substantially liquid phase (which is less dense than the substance 52), and the substance 52 could be a substantially solid phase (which is more dense than the substance 50).

The substance 50 in the FIG. 2 example is discharged to the mixer 36 (see FIG. 1) and forms a basis for the drilling fluid 12 returned to the drill string 14 by the pump 24. The substance 52 is discharged to a holding tank for subsequent disposal.

In other examples, the substances 50, 52 could both be substantially liquid phases having different densities. Thus, the scope of this disclosure is not limited to any particular substances separated by use of the centrifuge 34.

The thermal conductivity sensors 38, 40, 42 are used to determine operational parameters of the centrifuge 34 and/or to determine how changes in the operational parameters affect the substances 50, 52 discharged from the centrifuge 34. For example, outputs of the thermal conductivity sensors 38, 40, 42 can be used to assess whether the centrifuge 34 is efficiently and/or effectively separating the substances 50, 52. The output of the sensor 38 can be used to evaluate whether the substance 50 is suitable for use as the drilling fluid 12 (for example, whether undesirable solids, such as formation rock, have been removed from the substance, and whether desirable solids, such as weighting materials, remain in the substance). A comparison of the outputs of the sensors 38, 42 may be used to determine whether the centrifuge 34 is operating as intended, whether maintenance is needed, whether operation of the centrifuge should be adjusted (for example, by varying a rotational speed of a bowl or screw conveyor therein, etc.), and/or whether operation of the centrifuge has been optimized.

It is not necessary for all of the sensors 38, 40, 42 to be used with the centrifuge 34. For example, certain operational parameters of the centrifuge 34 and properties of the substance 50 and/or substance 52 can be determined using only one or two of the sensors 38, 40, 42. Thus, the scope of this disclosure is not limited to use of any particular number of thermal conductivity (or other heat transfer property) sensors.

Figure 3:
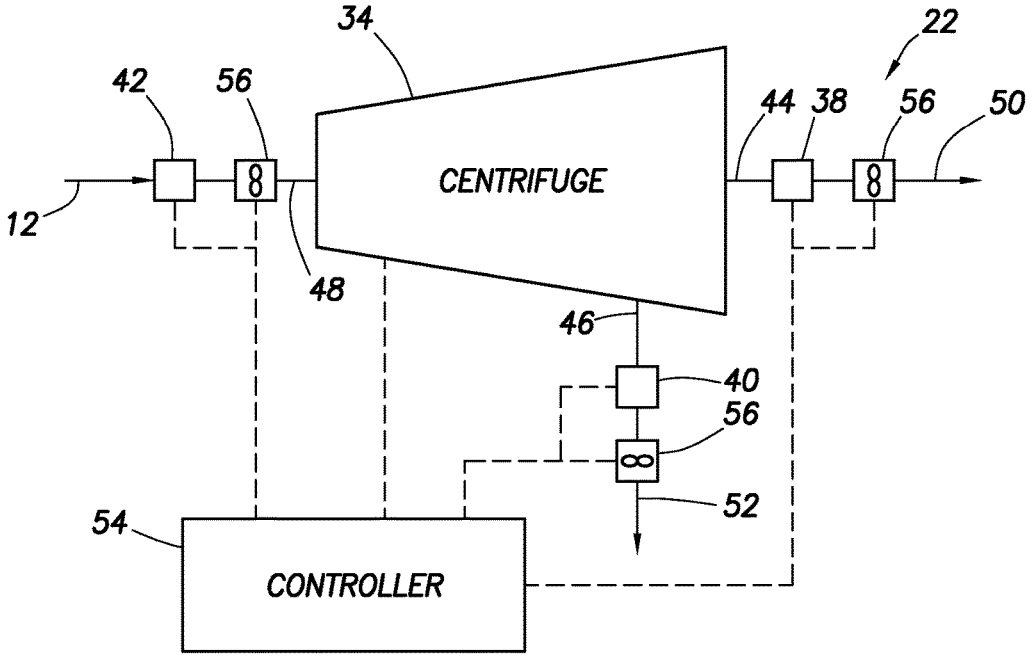
FIG. 3 is a representative schematic of another example of the drilling fluid conditioning system, in which operation of the centrifuge is controlled in response to thermal conductivity measurements.

FIG. 3 is a representative schematic of another example of the drilling fluid conditioning system 22, in which operation of the centrifuge 34 is controlled in response to the assessment(s) of its efficiency/effectiveness, properties of the substance 50 and/or substance 52, etc. Operation of the centrifuge 34 can be adjusted or varied as needed to improve its efficiency, to separate the substances 50, 52 more effectively, to properly condition the substance 50, to optimize operation of the centrifuge etc.

A controller 54 is included in the system 22 for controlling operation of the centrifuge 34. The controller 54 could, for example, be a PID (proportional integral differential) controller of the type that can control operation of a device as needed to influence a measured value toward a desired value or range.

However, the scope of this disclosure is not limited to use of any particular type of controller. In some examples, control of operation of the centrifuge 34 may be manually performed, based on the determinations/assessments resulting from the thermal conductivity measurements.

In some examples, one or more operational parameters of the centrifuge 34 may be changed, in order to see how such change(s) affect the substances 50, 52 being discharged, efficiency and/or effectiveness of the centrifuge, etc. Thus, it is not necessary for operational parameters of the centrifuge 34 to be changed only in response to the thermal conductivity measurements.

Additional flowmeters 56 are included in the system 22 of FIG. 3, connected at the input 48 and outputs 44, 46 of the centrifuge 34. The flowmeters 56 can be useful in measuring flow rates of the drilling fluid 12 into the centrifuge 34, and of the substances 50, 52 out of the centrifuge. Thus, any combination or types of sensors (such as, temperature, pressure, gas content, etc.) can be used in the system 22, in keeping with the principles of this disclosure.

Figure 4:
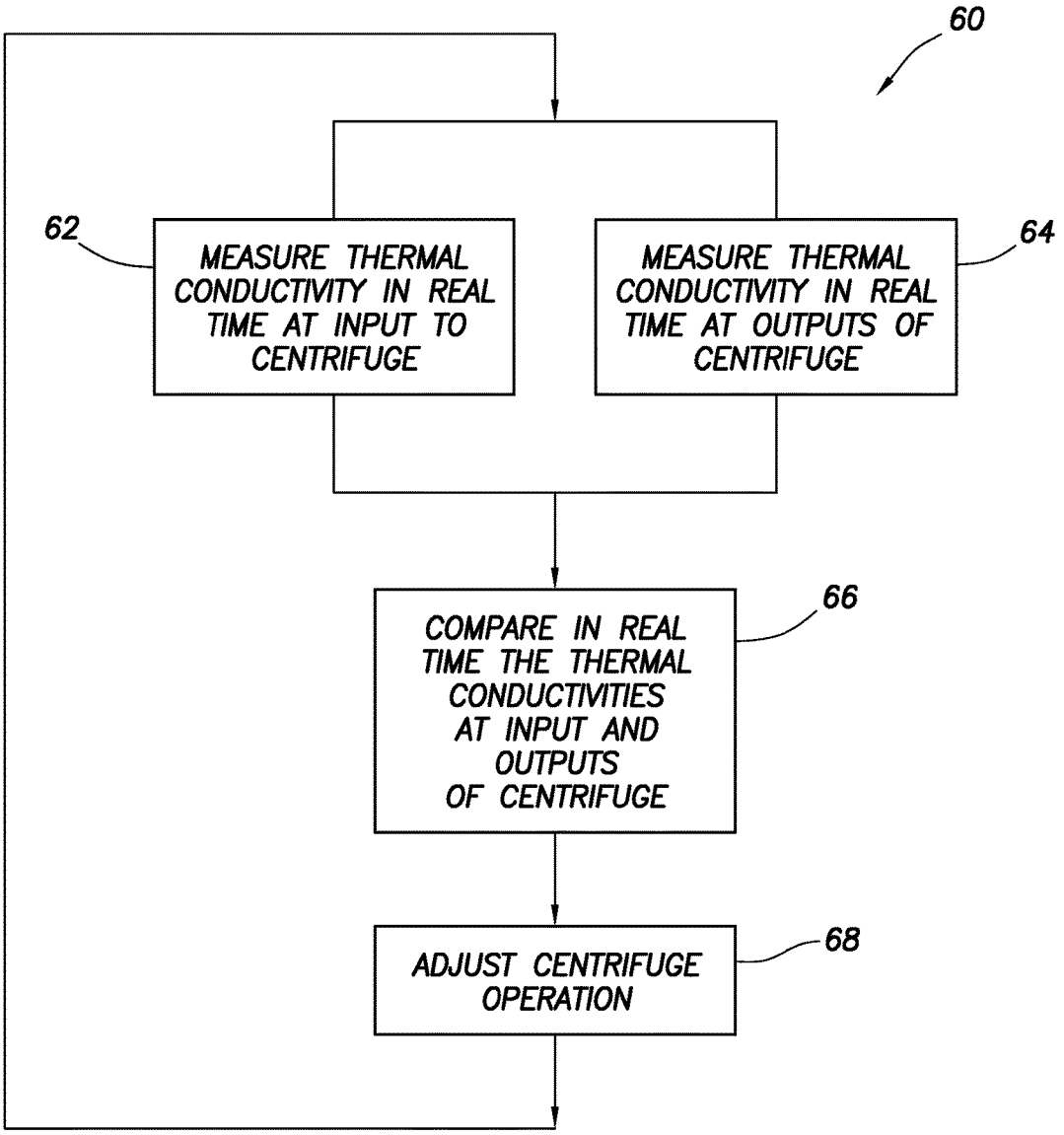
FIG. 4 is a representative flow chart for an example of the method.

FIG. 4 is a representative flow chart for an example of a method 60 of controlling operation of the centrifuge 34. The method 60 may be performed with the well system 10 of FIG. 1, or it may be performed with other well systems.

In steps 62 and 64 of the method 60, the thermal conductivity (or other heat transfer property) of the drilling fluid 12 is measured in real time at the input 48 and at the outputs 44, 46 of the centrifuge 34. However, as discussed above, the scope of this disclosure is not limited to use of multiple thermal conductivity sensors 38, 40, 42 or to use of thermal conductivity sensors at any particular location with respect to the centrifuge 34. It is also not necessary for the thermal conductivity measurements to be performed in real time.

In step 66, the thermal conductivities (or other heat transfer properties) of the drilling fluid 12 at the input 48 and outputs 44, 46 of the centrifuge 34 are compared. This comparison can yield valuable information as to an efficiency and/or effectiveness of the centrifuge 34 operation, changes in thermal conductivity caused by the centrifuge, etc. Appropriate decisions can then be made whether to perform maintenance on the centrifuge 34, to change any operational parameters of the centrifuge, etc.

In step 68, operation of the centrifuge 34 is adjusted, based on the thermal conductivity measurements. For example, if the thermal conductivity measurements indicate that a solids content of the discharged substance 50 deviates from a desired solids content, then operation of the centrifuge 34 can be changed as needed to influence the solids content toward the desired solids content. Operation of the centrifuge 34 can be optimized by changing adjustments, until optimal separation of the substances 50, 52 or maximum efficiency or effectiveness of the operation is obtained.

It may now be fully appreciated that the above disclosure provides significant advancements to the art of assessing and controlling operation of a centrifuge in a drilling fluid conditioning system. In some examples described above, operation of the centrifuge 34 can be varied in real time as needed, based on heat transfer property measurements made by the sensors 38, 40, 42. In other examples, effects of varying operation of the centrifuge 34 can be evaluated, based on the heat transfer property measurements.

The above disclosure provides to the art a drilling fluid conditioning system 22. In one example, the drilling fluid conditioning system 22 includes a centrifuge 34, and at least one heat transfer property sensor 38, 40, 42 that outputs real time measurements of a heat transfer property of a drilling fluid 12 that flows through the centrifuge 34.

The heat transfer property sensor 42 may be connected at an input 48 to the centrifuge 34. The heat transfer property sensor 38 may be connected at an output 44 of the centrifuge 34.

The "at least one" heat transfer property sensor can comprise first and second heat transfer property sensors 38, 40. The first heat transfer property sensor 38 measures the heat transfer property of the drilling fluid 12 at a first output 44 of the centrifuge 34, and the second heat transfer property sensor 40 measures the heat transfer property of the drilling fluid 12 at a second output 46 of the centrifuge 34.

The "at least one" heat transfer property sensor can also include a third heat transfer property sensor 42. The third heat transfer property sensor 42 measures the heat transfer property of the drilling fluid 12 at an input 48 to the centrifuge 34.

The drilling fluid conditioning system 22 can comprise a controller 54 that adjusts operation of the centrifuge 34 in response to the measurements of the heat transfer property of the drilling fluid 12.

A method 60 is also provided to the art by the above disclosure. In one example, the method 60 can comprise: measuring a heat transfer property of a drilling fluid 12, and determining, based on the measured heat transfer property, an operational parameter of a centrifuge 34 through which the drilling fluid 12 flows.

The measuring step may be performed at a drilling fluid conditioning system 22 proximate a surface of the earth.

The measuring step may be performed at an input 48 and at least one output 44, 46 of the centrifuge 34.

The "at least one" output can comprise first and second outputs 44, 46. The measuring step can be performed at each of the first and second outputs 44, 46.

The determining step may include comparing heat transfer property measurements performed at an input 48 and at least one output 44, 46 of the centrifuge 34.

The method can also include adjusting operation of the centrifuge 34 in response to the comparing step.

The method can include controlling operation of the centrifuge 34 in real time in response to the determining step.

The measuring step can comprise outputting the heat transfer property in real time.

A well system 10 is also described above. In one example, the well system 10 can comprise a drilling fluid 12 that circulates through a wellbore 20 and a drilling fluid conditioning system 22. The drilling fluid conditioning system 22 can include a centrifuge 34 and at least one heat transfer property sensor 38, 40, 42 that measures a heat transfer property of the drilling fluid 12.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A drilling fluid conditioning system for conditioning a drilling fluid, comprising:

a centrifuge;

a first heat transfer property sensor that outputs real time measurements of a heat transfer property of the drilling fluid that flows through a first output of the centrifuge; and a controller that adjusts operation of the centrifuge in response to the measurements of the heat transfer property of the drilling fluid.

2. The drilling fluid conditioning system of claim 1, further comprising a second heat transfer property sensor configured to measure the heat transfer property of the drilling fluid that flows through an input to the centrifuge.

3. The drilling fluid conditioning system of claim 1, further comprising a second heat transfer property sensor configured to measure the heat transfer property of the drilling fluid that flows through a second output of the centrifuge.

4. The drilling fluid conditioning system of claim 3, further comprising a third heat transfer property sensor configured to measure the heat transfer property of the drilling fluid that flows through an input to the centrifuge.

5. A method, comprising:

measuring a heat transfer property of a drilling fluid flowing through a first output of a centrifuge with a first heat transfer property sensor; and determining, based on the measured heat transfer property, an operational parameter of flail the centrifuge through which the drilling fluid flows with a controller.

6. The method of claim 5, wherein measuring the heat transfer property of the drilling fluid further comprises measuring the heat transfer property of the drilling fluid flowing through an input of the centrifuge with a second heat transfer property sensor.

7. The method of claim 5, wherein measuring the heat transfer property of the drilling fluid further comprises measuring the heat transfer property of the drilling fluid flowing through a second output of the centrifuge with a second heat transfer property sensor.

8. The method of claim 6, wherein the determining further comprises comparing heat transfer property measurements of the drilling fluid flowing through the input and the first output of the centrifuge.

9. The method of claim 8, further comprising adjusting operation of the centrifuge in response to the comparing.

10. The method of claim 5, further comprising controlling operation of the centrifuge in real time in response to the determining.

11. The method of claim 5, wherein the measuring further comprises outputting the heat transfer property in real time.

12. A well system, comprising:

a drilling fluid that circulates through a wellbore and a drilling fluid conditioning system, wherein the drilling fluid conditioning system comprises a centrifuge, and a first heat transfer property sensor that measures a heat transfer property of the drilling fluid flowing through a first output of the centrifuge; and a controller that adjusts operation of the centrifuge in response to the measurements of the heat transfer property of the drilling fluid.

13. The well system of claim 12, further comprising a second heat transfer property sensor configured to measure the heat transfer property of the drilling fluid flowing through an input to the centrifuge.

14. The well system of claim 12, further comprising a second heat transfer property sensor configured to measure the heat transfer property of the drilling fluid flowing through a second output of the centrifuge.

15. The well system of claim 14, further comprising a third heat transfer property sensor configured to measure the heat transfer property of the drilling fluid flowing through an input to the centrifuge.

* * * * *